US005682779A

United States Patent [19]

Dolev

[11] Patent Number: 5,682,779

[45] Date of Patent: Nov. 4, 1997

[54] MECHANICALLY CHANGEABLE CYLINDER LOCK AND KEY WITH ROTATING PINS

[76] Inventor: Moshe Dolev, 17 Bereshit, Ramat Hasharon, Israel

[21] Appl. No.: 399,016

[22] Filed: Mar. 6, 1995

[51] Int. Cl.[6] ..... E05B 27/00

[52] U.S. Cl. ..... 70/494; 70/378; 70/409; 70/411

[58] Field of Search ..... 70/493–496, 378, 70/383, 384, 395, 398, 399, 405–407, 409, 411

[56] References Cited

U.S. PATENT DOCUMENTS

| | | |
|---|---|---|
| Re. 30,198 | 1/1980 | Oliver et al. . |
| Re. 31,910 | 6/1985 | Oliver . |
| 666,697 | 1/1901 | Roche . |
| 939,679 | 11/1909 | Freud . |
| 1,259,353 | 3/1918 | Brintnall . |
| 1,549,581 | 8/1925 | Lewis . |
| 1,778,680 | 10/1930 | Long . |
| 1,859,451 | 5/1932 | Martocello . |

(List continued on next page.)

FOREIGN PATENT DOCUMENTS

| | | | |
|---|---|---|---|
| 1142768 | 3/1983 | Canada . | |
| 2398163 | 3/1979 | France | 70/398 |

*Primary Examiner*—Suzanne Dino

[57] ABSTRACT

A cylinder lock having a changeable key combination, the cylinder lock including a cylinder housing defining a bore, a plug arranged in the bore and defining a keyway and at least one plug pin disposed in the plug along at least one plug pin axis and communicating with the keyway, the at least one plug pin having a key engagement end face communicating with the keyway, the key engagement end face being configured such that rotation of the plug pin about the plug pin axis effects a change in the key combination of the cylinder lock and wherein the cylindrical housing defines at least one access opening which permits access to the at least one plug pin for selectable rotational positioning thereof for changing the key combination of the cylinder lock by means of rotation of the at least one plug pin about the at least one plug pin axis. Various keys suitable for use with the lock are also described and claimed.

20 Claims, 7 Drawing Sheets

U.S. PATENT DOCUMENTS

| | | | |
|---|---|---|---|
| 1,899,739 | 2/1933 | Von Mehren | 70/395 X |
| 1,917,302 | 7/1933 | Hill . | |
| 2,023,847 | 12/1935 | Liss | 70/47 |
| 2,113,007 | 4/1938 | Swanson . | |
| 2,194,469 | 3/1940 | Fremon | 70/364 |
| 2,221,664 | 11/1940 | Susser | 70/384 |
| 2,266,163 | 12/1941 | Ching . | |
| 2,453,066 | 11/1948 | Gabrielsen . | |
| 2,895,323 | 7/1959 | Kennedy . | |
| 3,059,462 | 10/1962 | Check . | |
| 3,143,875 | 8/1964 | Wellekens . | |
| 3,149,486 | 9/1964 | Russell et al. . | |
| 3,210,973 | 10/1965 | Basseches . | |
| 3,413,831 | 12/1968 | Crepinsek | 70/358 |
| 3,499,303 | 3/1970 | Spain . | |
| 3,514,982 | 6/1970 | Bergendahl | 70/384 |
| 3,589,153 | 6/1971 | Hill . | |
| 3,722,240 | 3/1973 | Spain et al. | 70/378 |
| 3,777,520 | 12/1973 | Crepinsek | 70/358 |
| 3,892,111 | 7/1975 | Bresler | 70/358 |
| 3,910,083 | 10/1975 | Burlingame . | |
| 3,955,388 | 5/1976 | Stackhouse | 70/411 |
| 3,985,010 | 10/1976 | Idoni | 70/378 X |
| 3,987,654 | 10/1976 | Iaccino et al. | 70/378 |
| 4,098,103 | 7/1978 | Raskevicius | 70/419 |
| 4,100,778 | 7/1978 | Gretler | 70/406 |
| 4,103,526 | 8/1978 | Surko, Jr. | 70/378 X |
| 4,208,894 | 6/1980 | Surko, Jr. | 70/494 |
| 4,289,002 | 9/1981 | Gretler | 70/406 X |
| 4,325,241 | 4/1982 | Keller | 70/378 X |
| 4,328,690 | 5/1982 | Oliver | 70/369 |
| 4,359,885 | 11/1982 | Goldman | 70/355 |
| 4,376,382 | 3/1983 | Raymond et al. . | |
| 4,393,673 | 7/1983 | Widen | 70/358 |
| 4,461,161 | 7/1984 | Shpigelman | 70/352 |
| 4,635,455 | 1/1987 | Oliver . | |
| 4,723,427 | 2/1988 | Oliver | 70/378 |
| 4,741,188 | 5/1988 | Smith | 70/383 |
| 4,760,722 | 8/1988 | Fann et al. | 70/378 X |
| 4,829,798 | 5/1989 | Roop | 70/379 R |
| 4,836,002 | 6/1989 | Monahan | 70/382 |
| 4,866,964 | 9/1989 | Hall | 70/369 |
| 4,905,489 | 3/1990 | Keller | 70/378 |
| 4,912,953 | 4/1990 | Wobig . | |
| 4,932,229 | 6/1990 | Genakis | 70/494 |
| 4,998,426 | 3/1991 | Genakis | 70/378 X |
| 5,067,335 | 11/1991 | Widen | 70/495 |
| 5,103,661 | 4/1992 | Fann et al. | 70/360 |
| 5,161,397 | 11/1992 | Raybary | 70/374 |
| 5,170,651 | 12/1992 | Errani | 70/395 X |
| 5,176,015 | 1/1993 | Sussina | 70/369 |
| 5,187,957 | 2/1993 | Yang | 70/409 X |
| 5,289,709 | 3/1994 | Field | 70/494 |
| 5,349,830 | 9/1994 | Keller | 70/358 |

MECHANICALLY CHANGEABLE CYLINDER LOCK AND KEY WITH ROTATING PINS

FIELD AND BACKGROUND OF THE INVENTION

The present invention relates to cylinder locks, and particularly to cylinder locks having rotatable pins provided with means for manually resetting the lock.

It is occasionally desirable to change a lock. This is typically motivated by security considerations. For example, it is sometimes desired to deny future access to a person who had previously been, but is no longer, authorized to gain access. Similarly, the lock may be changed in order to foreclose the possibility of gaining access by a thief or finder of a lost key. Using conventional technology, the changing of a lock requires the removal of the existing cylinder lock and its replacement with a different lock.

To obviate the need for replacing the cylinder lock, it has been proposed to construct the cylinder lock in such a way that its combination is mechanically alterable. Illustrative of the considerable body of prior art teaching mechanically alterable locks are U.S. Pat. Nos. 4,912,953, 4,376,382, 3,589,153, 3,210,973, 3,149,486, 3,143,875, 3,059,462, 2,895,323, 2,453,066, 2,266,163, 2,113,007, 1,917,302, 1,778,680, 1,859,451, 1,259,353, 666,697 and 3,910,083, which are incorporated by reference for all purposes as if fully set forth herein.

While the combination of such locks can be readily altered without having to replace the cylinder lock, all these systems suffer from the disadvantage that the key or keys must be replaced every time the cylinder lock combination is changed. The replacement of the key or keys typically requires the purchase of a new key or keys. More importantly, the requirement for new keys typically requires some interaction between the user and a professional locksmith in the course of the change of the cylinder lock combination. This interaction is costly both in terms of cost and in terms of speed and convenience.

One of the most secure cylinder locks, and one of the best known, is the rotatable pin lock known as the Medeco lock. The Medeco lock is described in great detail in a number of publications, among them are U.S. Pat. Nos. 3,499,303, 4,635,455, U.S. Pat. Nos. Re. 30,198 and 31,910, which are incorporated by reference for all purposes as if fully set forth herein.

Because the Medeco lock is so well known and because it is fully described in the references cited above, only a brief description of the lock is offered herein. Those not sufficiently familiar with the Medeco lock are referred to above-referenced references, and, in particular, to U.S. Pat. No. Re. 30,198.

The Medeco cylinder lock utilizes slotted pins which are rotatable. Insertion of a proper key into the keyway of the key plug causes the pins to rotate to a position wherein the slots of all the pins are aligned to one side. The Medeco key resembles a conventional key except that each of its bits can be at one of three angles to the axis of the key blade. One of the three angles is 90° as in conventional keys. The other two possible angles are typically a small positive or negative angle, such as 10°, from the axis of the key blade.

A sidebar which includes a set of lugs, one for each slotted pin, is biased toward the keyway. When, and only when, all the slots are properly aligned, as when a proper key has been inserted, the lugs of the sidebar are able to penetrate the slots. This displacement of the sidebar helps disengage the key plug from the cylinder shell and makes it possible to rotate the key plug relative to the cylinder shell, thereby effecting the locking or unlocking. If one or more of the slots is not properly aligned, as when no key or a wrong key is in the keyway, the sidebar is not able to approach the key plug and serves to immobilize the key plug relative to the cylinder shell. In this position the key plug cannot be rotated and no locking or unlocking is possible. In addition, the known Medeco locks include, as do conventional cylinder locks, pins of different lengths and driver pins which penetrate partly into the cylinder shell to prevent rotation and which align to form a shear line at the boundary between the key plug and the cylinder shell when a proper key is used.

Although the Medeco lock, in its various versions, is an extremely reliable lock, it suffers from at least one disadvantage in that the combination of the lock is not changeable. Thus, whenever it is desired to alter the lock combination it is necessary to replace the relatively expensive lock and its keys.

There is thus a widely recognized need for, and it would be highly advantageous to have, a simple, reliable and inexpensive, Medeco-type cylinder lock system which makes it possible, using simple tools without professional assistance, to change the combination of both the cylinder lock and the key or keys.

SUMMARY OF THE INVENTION

According to the present invention there is provided a cylinder lock system with changeable combination, comprising: (a) a cylinder lock; and (b) a key for operating the cylinder lock; the cylinder lock system being characterized in that the changing of the combination of the cylinder lock simultaneously correspondingly changes the combination of the key.

Also according to the present invention, there is provided a cylinder lock, comprising at least one rotatable and axially displaceable pin, the at least one rotatable pin having an upper section and a lower section, the lower section featuring a longitudinally-extending pin slot, the lower section being rotatable, upon the application of sufficient force, relative to the upper section.

Further according to the present invention there is provided a cylinder lock whose combination is changeable and which is operated by a proper key which is also changeable through the rotation of at least one rotatable slotted member, comprising: (a) a cylinder shell having an outer surface and an inner surface, the cylinder shell having a longitudinally-extending shell sidebar recess on the inside surface of the cylinder shell, the cylinder shell further having at least one radially-extending hole therethrough for changing the combination of the lock; (b) a key plug rotatably mounted in the cylinder shell, the key plug having an axial keyway and at least one radially-extending key plug pin hole passing partially therethrough from the keyway to an outside surface of the key plug at a location corresponding to the at least one radially-extending hole of the cylinder shell and a longitudinally-extending plug sidebar recess on an outside surface of the key plug; (c) at least one rotatable pin mounted in the key plug pin hole to rotate and axially displace in the key plug pin hole upon engagement of the rotatable pin with the slotted member of the proper changeable key, the at least one rotatable pin having an upper section for engaging the at least one rotatable slotted member of the changeable key, the rotatable pin further having a lower section which features a longitudinally-extending pin slot, the lower section being rotatable, upon the application of sufficient force, relative to the upper section; and (d) a sidebar serving to rotationally immobilize the key plug relative to the cylinder shell by straddling the plug sidebar recess and the shell sidebar recess when the proper key is not in the keyway, the sidebar having at least one projection for partially penetrating the pin slot of the lower section of the at least one rotatable pin, the at least one projection being positioned and shaped so that the rotational and axial position of the rotatable pin, upon engagement of the at least one rotatable pin with the proper changeable key, permits the sidebar to withdraw from the shell sidebar recess, thereby permitting rotation of the key plug within the cylinder shell.

Yet further according to the present invention, there is provided a key comprising a key bow and a key blade, the key blade having two sides, with at least one of the sides featuring one or more slotted members, which may be rotatable.

Finally, according to the present invention there is provided a system which includes a changeable cylinder lock and a changeable key as described above. As used herein, the term "changeable " refers to a changeable combination rather than to the replacement of the components in question.

According to further features in preferred embodiments of the invention described below, the cylinder lock further includes at least one driver pin, wherein the cylinder shell further includes a cylinder shell pin hole corresponding to the key plug pin hole, the cylinder shell pin hole located and dimensioned to accommodate the at least one driver pin, the driver pin serving to rotationally immobilize the key plug relative to the cylinder shell by its straddling the key plug pin hole and the cylinder shell pin hole when the proper key is not in the keyway, the driver pin being biased in the direction of the keyway so as to contact the rotatable pin or an adjacent spacer pin at a boundary and thereby bias the rotatable pin in the direction of the keyway, the rotatable pin (and spacer pin, when present) being of a length such that the axial position of the rotatable pin, upon engagement of the at least one rotatable pin with the proper changeable key, is such that the rotatable pin (and spacer pin, when present) is located entirely within the key plug pin hole and the driver pin is located entirely within the cylinder shell pin hole, thereby permitting rotation of the key plug within the cylinder shell.

The present invention successfully addresses the shortcomings of the presently known configurations by providing a cylinder lock with rotatable pins and a key to operate the cylinder lock, with the combinations of both the cylinder lock and the key being readily changeable among a very large number of combinations. The cylinder lock includes at least one pin which includes two sections. The two sections are rotatable relative to each other upon the application of sufficient force during the process of changing the lock combination. The key includes at least one rotatable slotted member which engages the rotatable pin. The slotted member can be rotated upon the application of sufficient force to during the process of changing the lock combination which can be effected simultaneously with the changing of the cylinder lock with the key in the keyway or which can alternatively be effected solely on the key with the key out of the keyway.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a cylinder lock, a cylinder lock key and a cylinder lock system which allows the user to readily change the combination of both the lock and the key using simple tools and without requiring professional assistance.

The principles and operation of a cylinder lock, key and system according to the present invention may be better understood with reference to the drawings and the accompanying description.

Figure 1:
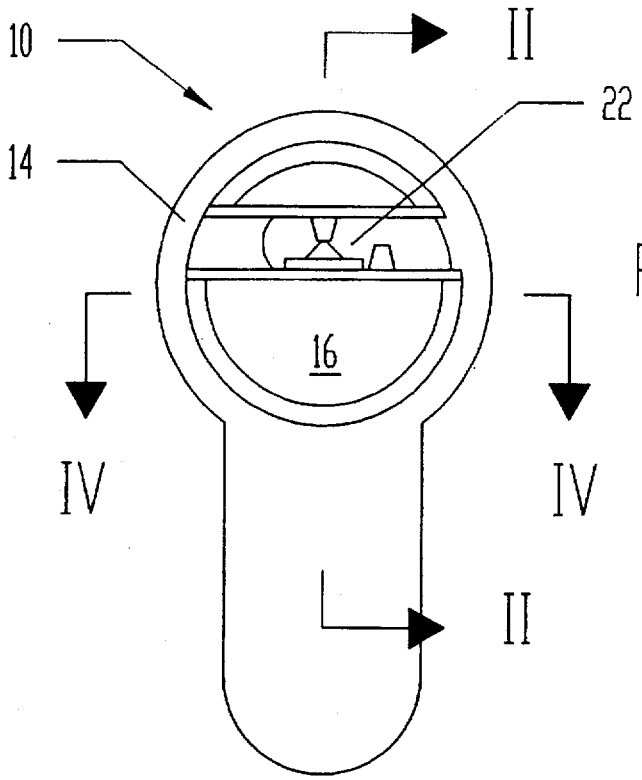
FIG. 1 is an end view of a cylinder lock according to the present invention.
Figure 2:
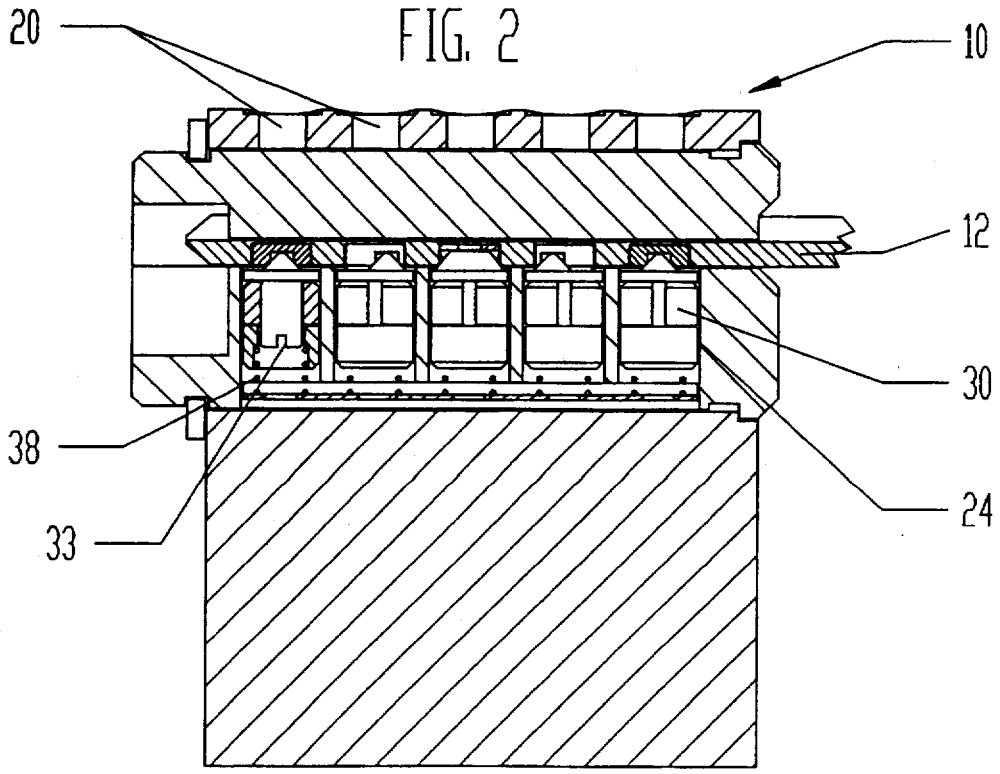
FIG. 2 is a side cross-sectional view of one embodiment of a cylinder lock according to the present invention along section II—II of FIG. 1.
Figure 4:
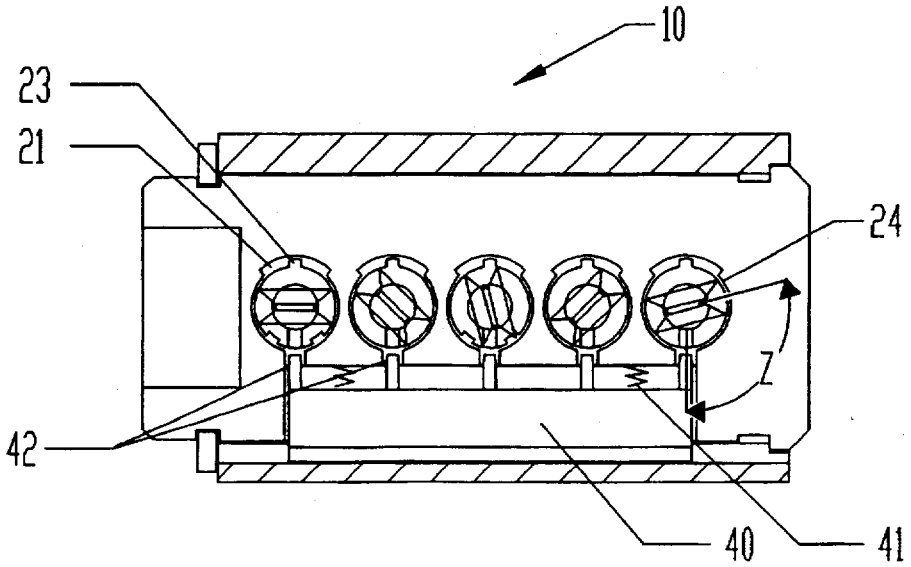
FIG. 4 is a top cross-sectional view of the cylinder lock of FIG. 1 along section IV—IV of FIG. 1.
Figure 7:
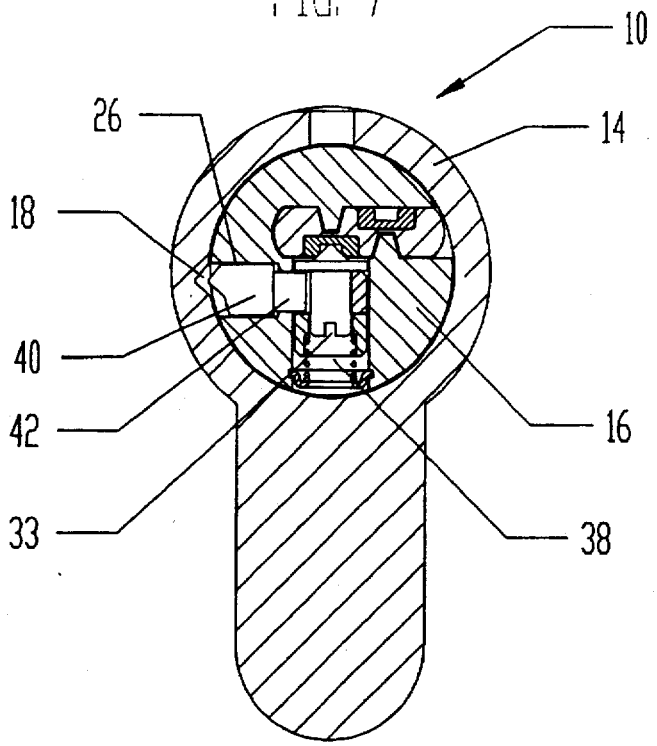
FIG. 7 is an end cross-sectional view of a cylinder lock of FIG. 2 along section VII—VII of FIG. 6.

Referring now to the drawings, FIGS. 1 and 7 are an end views (FIG. 7 being a cross-sectional view) of a basic embodiment of a cylinder lock according to the present invention. The views represented by the two section lines indicated in FIG. 1 (II—II and IV—IV) are shown in FIGS. 2 and 4, respectively.

A changeable cylinder lock 10 according to the present invention is designed to be operated by a proper key 12 which is also changeable, either simultaneously with cylinder lock 10 or independently, as described below.

Figure 3:
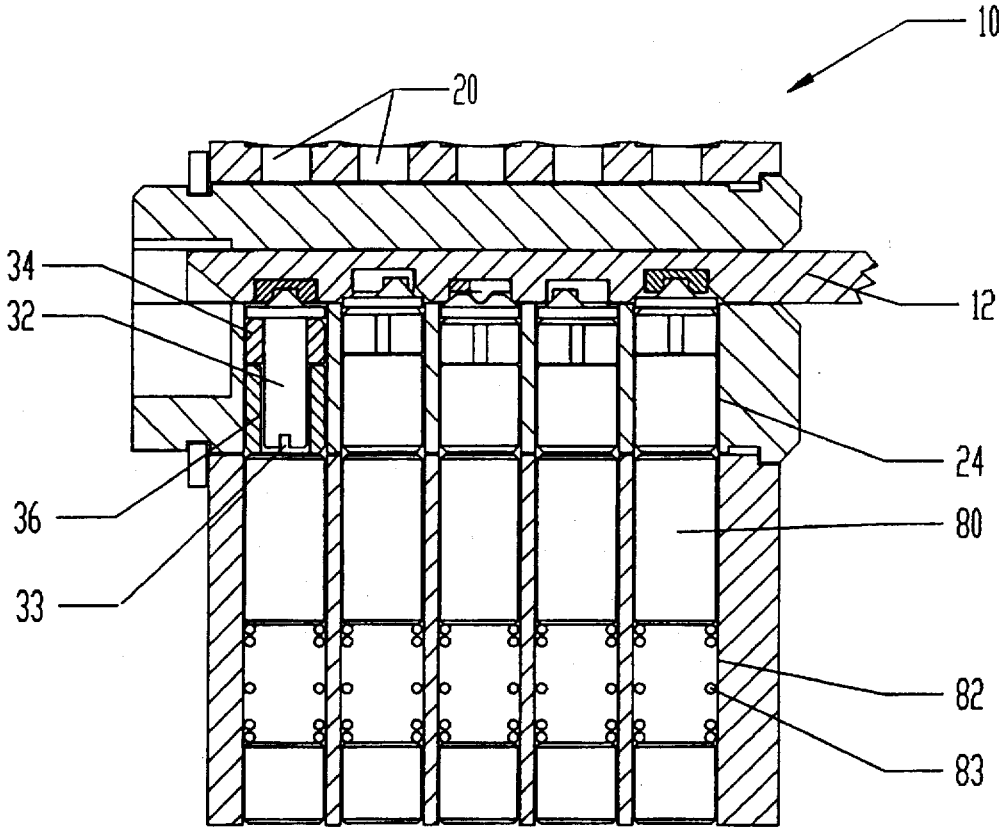
FIG. 3 is a side cross-sectional view of another embodiment of a cylinder lock according to the present invention along section II—II of FIG. 1.
Figure 6:
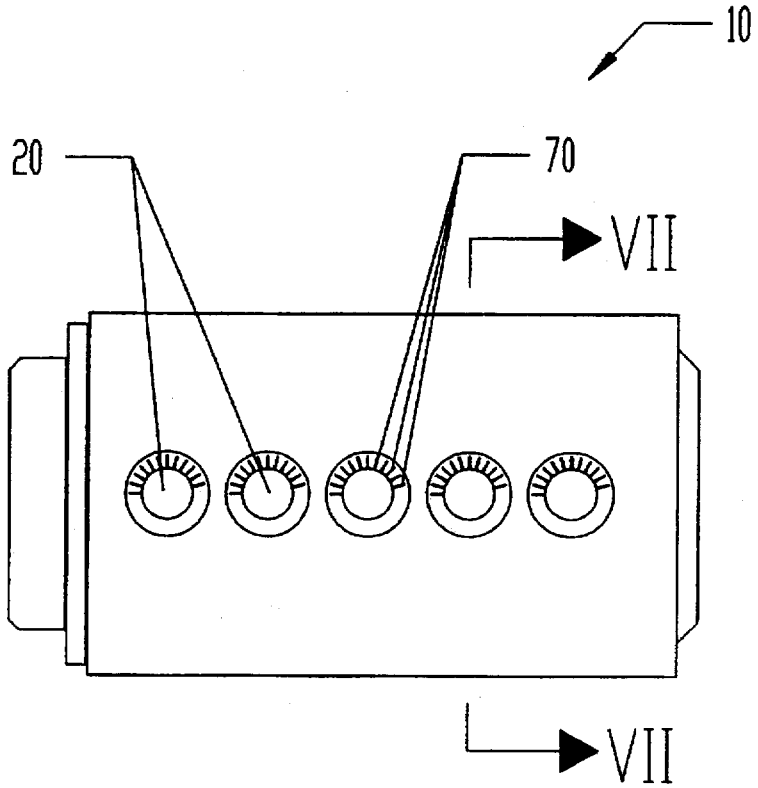
FIG. 6 is a is a top view of a cylinder lock according to the present invention.

Cylinder lock 10 includes a cylinder shell 14 and a key plug 16 which is rotatably mounted within cylinder shell 14. Cylinder shell 14 has a longitudinally-extending shell sidebar recess 18 (FIG. 7) on its inside surface. Cylinder shell 14 further features one or more radially-extending holes 20 which pass therethrough (five such holes are shown in FIGS. 2, 3 and 6). Preferably, each of radially-extending holes 20 includes a recess 21 (FIG. 4) whose function is to keep the rotatable pin described below within a certain range of angles. Holes 20 are used to allow the combination of cylinder lock 10 to be changed, as described in more detail below.

Key plug 16 is formed with an axial keyway 22 (FIG. 1). Key plug 16 further includes one or more radially-extending key plug pin holes 24 (five are shown in FIGS. 2–4), each of which passes partially through key plug 16 from keyway 22 to the outside surface of key plug 16 at a location which is aligned with the corresponding radially-extending hole 20 of cylinder shell 14. Key plug 16 also features a longitudinally-extending plug sidebar recess 26 (FIG. 7) on its outside surface.

Cylinder lock 10 further includes one or more rotatable pins 30 (five are shown in FIG. 2) which are each mounted in its respective key plug pin hole 24. Rotatable pins 30 are rotatable about their axes and are axially displaceable within key plug pin hole 24 upon engagement of rotatable pin 30 with a slotted member of a proper changeable key 12, as is described in more detail below. The degree of rotation of rotatable pins 31 is preferably limited by a tang 23 (FIG. 4) which is able to move only within a recess 21 of radially-extending holes 20.

Figure 5:
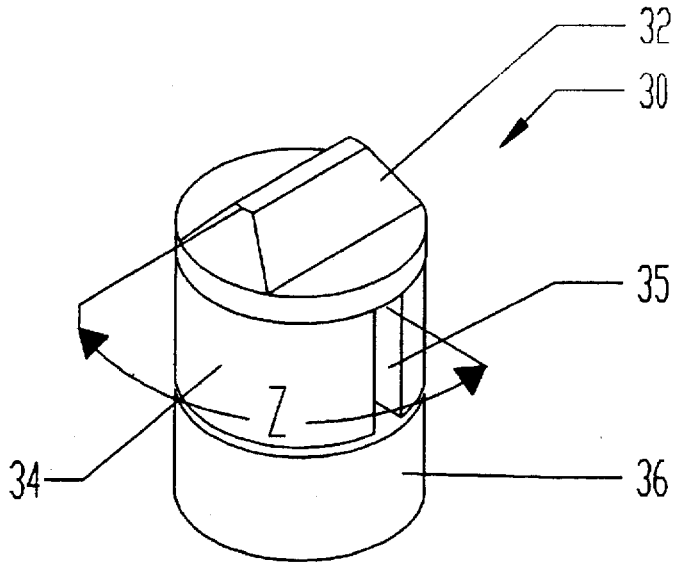
FIG. 5 is a perspective view of a pin used in the present invention.

Rotatable pin 30 is shown in enlarged perspective view in FIG. 5. Rotatable pin 30 is made up of at least two sections. Rotatable pin 30 has an upper section 32 for engaging the corresponding rotatable slotted member of changeable key 12, as described in more detail below. Preferably, upper section 32 of rotatable pin 30 is in the form of a chisel head, as shown in FIG. 5. The lower surface of upper section 32 features a slot 33 (FIGS. 2, 3 and 7) or similar mechanism to facilitate rotation of upper section 32 as described below.

Rotatable pin 30 further includes a lower section 34 which is connected to upper section 32, for example, by press fitting, so as to allow for controlled rotation. Lower section 34 features a longitudinally-extending pin slot 35 over at least a portion of its length. Lower section 34 is rotatable relative to upper section 32 upon the application of a sufficient force, as is described in more detail below. It is this relative rotation of lower section 34 and upper section 32 (through an angle Z, as shown in FIG. 5) which allows the combination of cylinder lock 10 to be readily changed, as described below.

Preferably, underlying rotatable pin 30 is a spacer pin 36 which is not connected to rotatable pin 30 and which is freely rotatable relative to lower section 34 of rotatable pin 30. The function of spacer pin 36 is described below. A suitable biasing mechanism, such as a pin spring 38 (FIG. 7) is used to bias spacer pin 36 in the direction of keyway 22.

Finally, cylinder lock 10 includes a sidebar 40 (FIGS. 4 and 7) which serves to rotationally immobilize key plug 16 relative to cylinder shell 14. The immobilization is effected by virtue of sidebar 40 straddling plug sidebar recess 26 and shell sidebar recess 18 whenever a proper key is not in inserted keyway 22, as can be seen, for example, in FIG. 8.

Sidebar 40 includes projections 42, one for each rotatable pin 30 with a slotted lower section 34. Projections 42 are dimensioned to partially penetrate pin slot 35 of lower section 34 of the corresponding rotatable pin 30. Preferably, pin slot 35 is just slightly longer than the corresponding dimension of projection 42 so that projection 42 can penetrate slot 35 only if projection 42 and slot 35 are accurately aligned both in the rotational and in the axial sense. This requirement makes it virtually impossible to pick a cylinder lock according to the present invention and greatly adds to the security of the lock.

Each of projections 42 is positioned and shaped so that the rotational and axial position of rotatable pin 30 and driver pin 36, upon engagement of rotatable pins 30 with a proper changeable key 12, permits sidebar 40 to withdraw from cylinder shell sidebar recess 18, thereby permitting rotation of key plug 16 within cylinder shell 14. In some cases, it may be desirable to make one or more pin slots 35 of a width which is larger than necessary to accommodate its corresponding projection 42 which makes it possible to use various master keys, i.e., keys which will open more than one particular lock.

Preferably, sidebar 40 is biased, as with a suitable spring 41 (FIG. 4) in the direction away from keyway 22 so that whenever sidebar 40 is aligned with cylinder shell sidebar recess 18, a portion of sidebar 40 enters cylinder shell sidebar recess 18 and thus straddles cylinder shell 14 and key plug 16 so as to rotationally immobilize key plug 16 relative to cylinder shell 14 and prevent the activation of cylinder lock 10.

It will be appreciated that sidebar 40 may not necessarily be shaped as shown in the figures and as described above. For example, the sidebar may by a side pin or other elements which serve the same functions. All these elements are intended to be covered by the term sidebar as used herein in the specification and claims.

Figure 12:
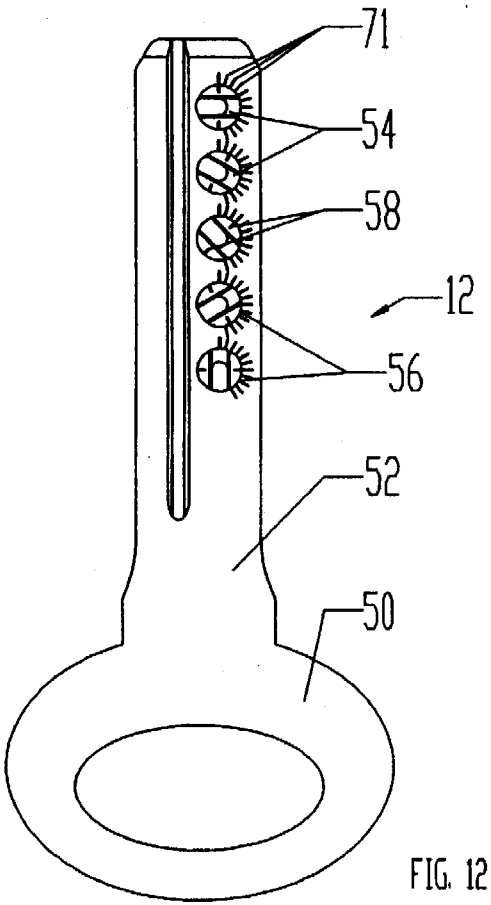
FIG. 12 shows a key according to the present invention.

An illustrative embodiment of a changeable key 12 according to the present invention is shown in FIG. 12. Key 12 includes a bow 50 and a blade 52. Blade 52 includes one or more rotatable slotted members 54 (five are shown in FIG. 12).

Each of rotatable slotted member 54 is designed to be engaged by upper section 32 of rotatable pin 30. In particular, for the embodiment illustrated in the Figures, the chisel head portion of upper section 32 of rotatable pin 30 is dimensioned to fit into rotatable slotted member 54 so that the sloping sides of the chisel head (FIG. 5) directly engage the beveled edges 56 (FIG. 13) of rotatable slotted member 54.

Preferably, rotatable slotted member 54 resembles a horseshoe or a special purpose circlip, similar to those available from Bossart or Switzerland and Seeger of Germany.

Preferably, each of rotatable slotted members 54 fits snugly into a recess 56, preferably circular, in blade 52 of key 12. The tight fit of rotatable slotted member 54 within recess 56 and the elasticity and outward bias of rotatable slotted member 54 are selected so that rotatable slotted member 54 may be rotated within recess 56 but only upon the application of sufficient force, preferably with the use of a screwdriver-like tool, as described below.

In operation, a system according to the present invention functions as follows. Each of rotatable pins 30 features a certain angle between the direction of its chisel-headed upper section 32 and its pin slot 35 (FIGS. 2 and 4). Proper key 12 has its rotatable slotted members 54 oriented so that, when proper key 12 is inserted into keyway 22, upper section 32 and slotted lower section 34 of each of rotatable pins 30 are together made to automatically rotate so that the chisel heads of upper sections 32 of each of rotatable pins 30 properly engages the corresponding rotatable slotted members 54 on key 12.

The rotation of rotatable pins 30 causes all the slots 35 of rotatable pins 30 to be aligned (FIG. 2) in the direction of sidebar 40. At this point, because of the shape of sidebar 40, rotational force on key 12 pushes sidebar 40 in the direction of rotatable pins 30. Since slots 35 are all properly aligned, the force put on sidebar 40 which is directed toward rotatable pins 30 causes projections 42 of sidebar 40 to partially penetrate slots 35. The displacement of sidebar 40 allows sidebar 40 to withdraw completely from cylinder shell sidebar recess 18, thereby allowing the rotation of key plug 16 within cylinder shell 14.

If an improper key is used, one or more of slots 35 will not be properly aligned so that force put on sidebar 40 which is directed toward rotatable pins 30 will not cause projections 42 of sidebar 40 to partially penetrate slots 35 which will leave sidebar 40 partially in cylinder shell sidebar recess 18 and will thus prevent the rotation of key plug 16 within cylinder shell 14.

Figure 10:
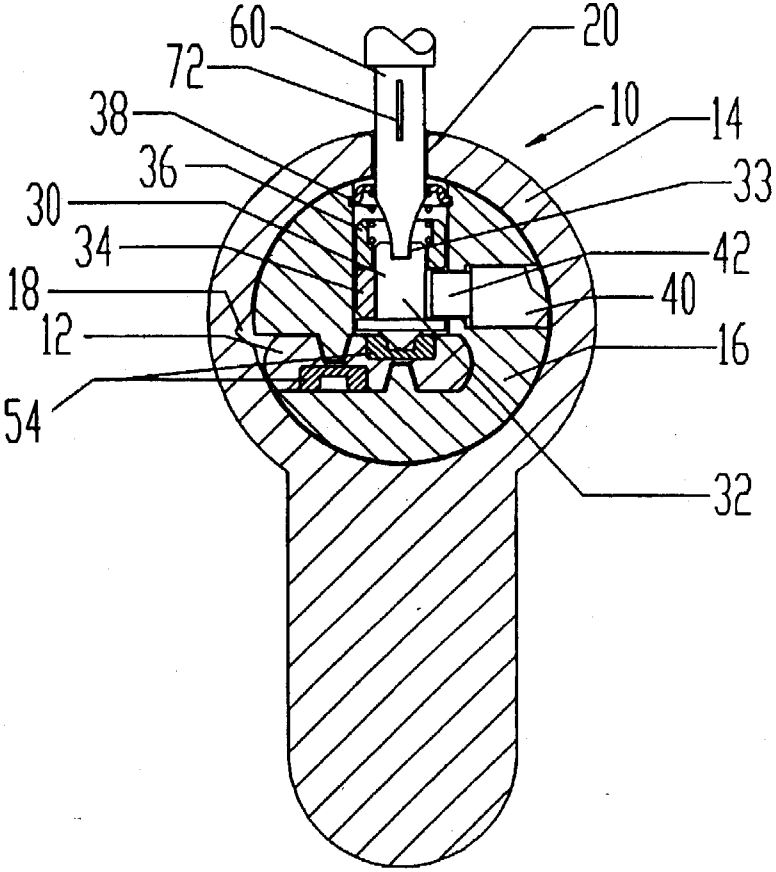
FIG. 10 is a close up view of a portion of FIG. 9.
Figure 9:
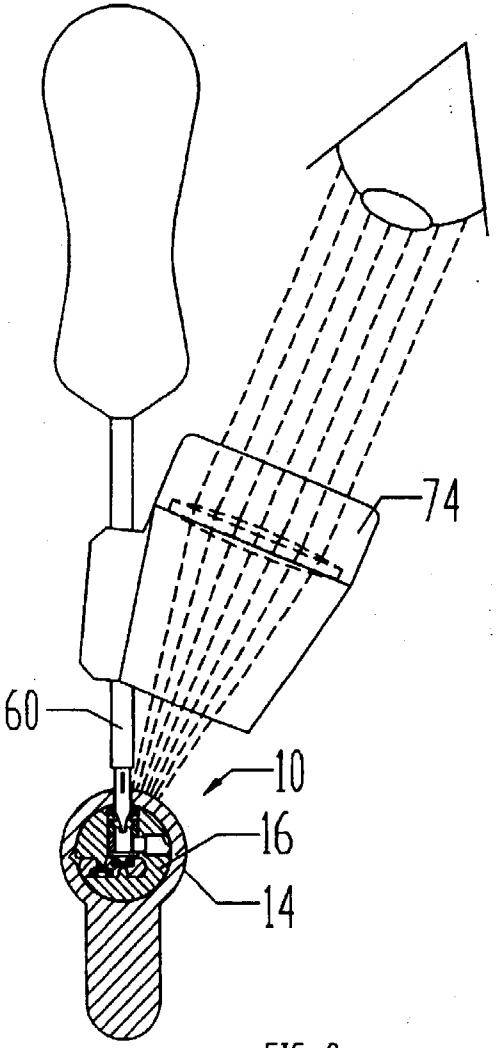
FIG. 9 depicts the process of simultaneously changing the lock and key combination.
Figure 11:
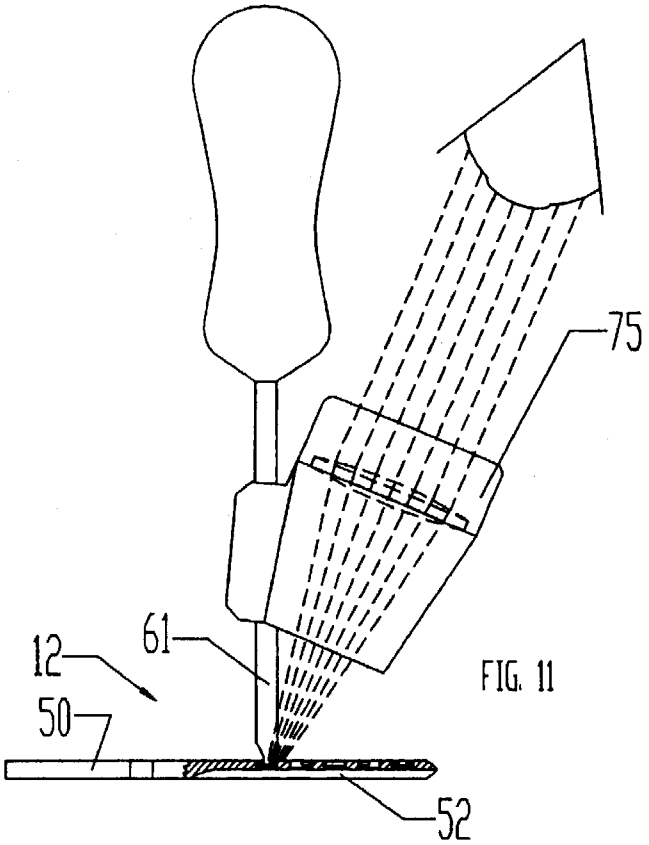
FIG. 11 depicts the process of independently changing the key combination.

Whenever it is desired to change the combination of cylinder lock 10, the following procedure is followed, as illustrated in FIGS. 9–11. First, cylinder lock 10 is removed from the door, and the like, so as to permit access to radially-extending holes 20 of cylinder shell 14. A proper key 12 is inserted into keyway 22 so as to allow key plug 16 to be rotated within cylinder shell 14.

Key plug 16 is then rotated, approximately 180° in the case of the configuration illustrated in FIGS. 2 and 10, so that holes 20 are aligned with rotatable pins 30 (FIG. 10). Once holes 20 have been properly aligned with rotatable pins 30 a screwdriver-like tool 60 is inserted through hole 20 so as to engage slot 33 in the lower surface of upper section 32 of rotatable pin 30. Spacer pin 36 is hollow so as to allow access to slot 33 of upper section 32.

Rotation of tool 60 brings about a relative rotation between upper section 32 and lower section 34 which is unable to rotate because it is immobilized by the presence of protrusion 42 of sidebar 40 in slot 35 of lower section 34. It will be noted that the rotation of tool 60 also simultaneously serves to rotate the corresponding rotatable slotted member 54 of key 12 which is engaged by the chisel head portion of upper section 32 of rotatable pin 30. In this way, the combination of key 12 is automatically altered at the same time and in the same way as the alteration of the combination of cylinder lock 10.

In this manner, any desired relative angle between upper section 32 and slot 35 of lower section 34 may be achieved. To facilitate the setting of a proper angle, the outer surface of cylinder shell 14 surrounding each hole 20 features suitable cylinder shell markings 70 (FIG. 6) while tool 60 features marking 72 (FIG. 10). Various reproducible angles can thus be set by aligning a specific shell marking 70 with tool marking 72. The alignment process is facilitated by using a loupe 74 (FIG. 9) or other optical system which is properly focused to provide the user an accurate view of the markings. Preferably, loupe 74 is attached to tool 60 to ensure proper focus and facilitate the process.

The number of possible combinations available for each cylinder lock is quite large. For example, if only 12 different angles (see markings in FIG. 6) are used on each of five pins, the number of possible permutations is $12^5$ or 248,832. To increase the number of permutations further one could use more than 12 angles per pin and/or more pins. Alternatively or additionally, one could use pins of several different lengths and corresponding rotatable slotted members which are recessed in the key to greater or lesser extents. An example of this is shown in FIG. 3, where rotatable pins 30 are of different lengths and wherein the various rotatable slotted members have a different height relative to an exterior surface of blade 52 of key 12.

A key according to the present invention may feature rotatable slotted members on only one side or on both sides. As described above, the combination of one set of rotatable slotted members is automatically altered when the combination of the cylinder lock is altered. If desired, the rotatable slotted members on the other side of the key, as well as the rotatable slotted members on one or both sides of any duplicate keys are readily changed as depicted in FIG. 11. A tool 61 which is similar to tool 60 (FIG. 9) is used to rotate rotatable slotted members 54 to the desired positions. To facilitate the exact rotation a portion of blade 52 of key 12 surrounding rotatable slotted members 54 features markings 71 similar to markings 70 (FIG. 6) on cylinder shell 14, to facilitate the changing of the combination of the key. To further facilitate the precise rotation of rotatable slotted members 54, each of rotatable slotted members 54 preferably features notches 58 (FIGS. 12 and 13) which is used in the alignment process. Preferably a loupe 75 is attached to tool 61 as described above with reference to tool 60.

The basic embodiment described above relies entirely on the sidebar to rotationally immobilize the key plug relative to the cylinder shell. In an alternative embodiment according to the present invention, use is made of driver pins which penetrate the cylinder shell when a proper key is not inserted in the keyway so as to provide additional, or alternative, rotational immobilization of the key plug relative to the cylinder shell.

Figure 8:
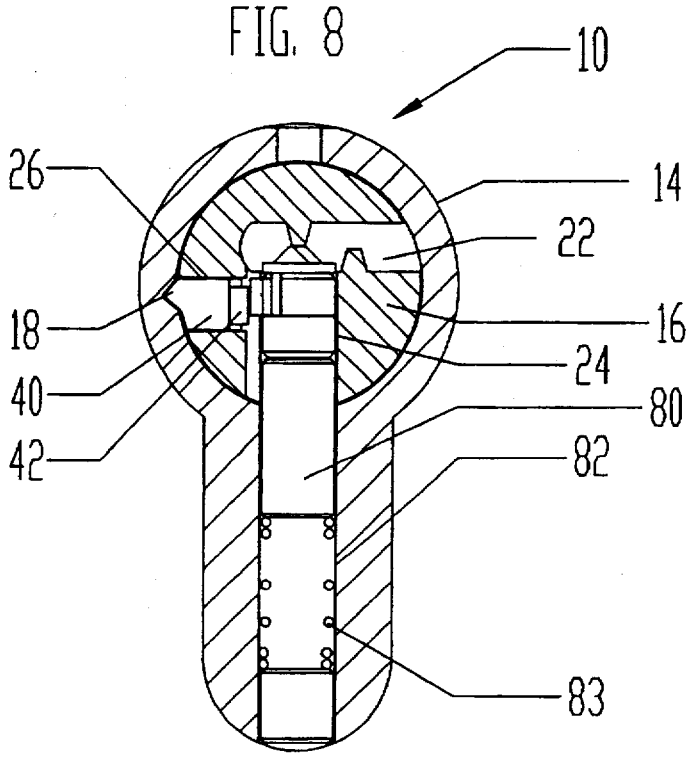
FIG. 8 is an end cross-sectional view of a cylinder lock of FIG. 3 along section VII—VII of FIG. 6.

In this alternative embodiment, illustrated in FIGS. 3 and 8, use is made of driver pins 80. Cylinder shell 14 includes a cylinder shell pin hole 82 which corresponds to key plug pin hole 24. Cylinder shell pin hole 82 is located and dimensioned to accommodate driver pin 80. Driver pin 80 serves to rotationally immobilize key plug 16 relative to cylinder shell 14 through its straddling of key plug pin hole 24 and cylinder shell pin hole 82 whenever a proper key is not in keyway 22 (as in FIG. 8).

Driver pin 80 is biased in the direction of keyway 22 so as to contact spacer pin 36 at a boundary and thereby bias spacer pin 36 and rotatable pin 30 in the direction of keyway 22. Rotatable pin 30 and spacer pin 26 are of a combined length such that the axial position of rotatable pin 30, upon the engagement of rotatable pin 30 with proper changeable key 12, is such that rotatable pins 30 and spacer pins 36 are located entirely within key plug pin hole 24 and driver pins 80 are located entirely within cylinder shell pin hole 82 (as in FIG. 3), thereby permitting rotation of the key plug within the cylinder shell.

Figure 13:
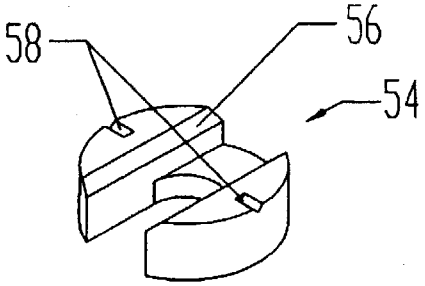
FIG. 13 is a perspective view of a rotatable slotted member resembling a horseshoe or a circlip used in a key according to the present invention.
Figure 14:
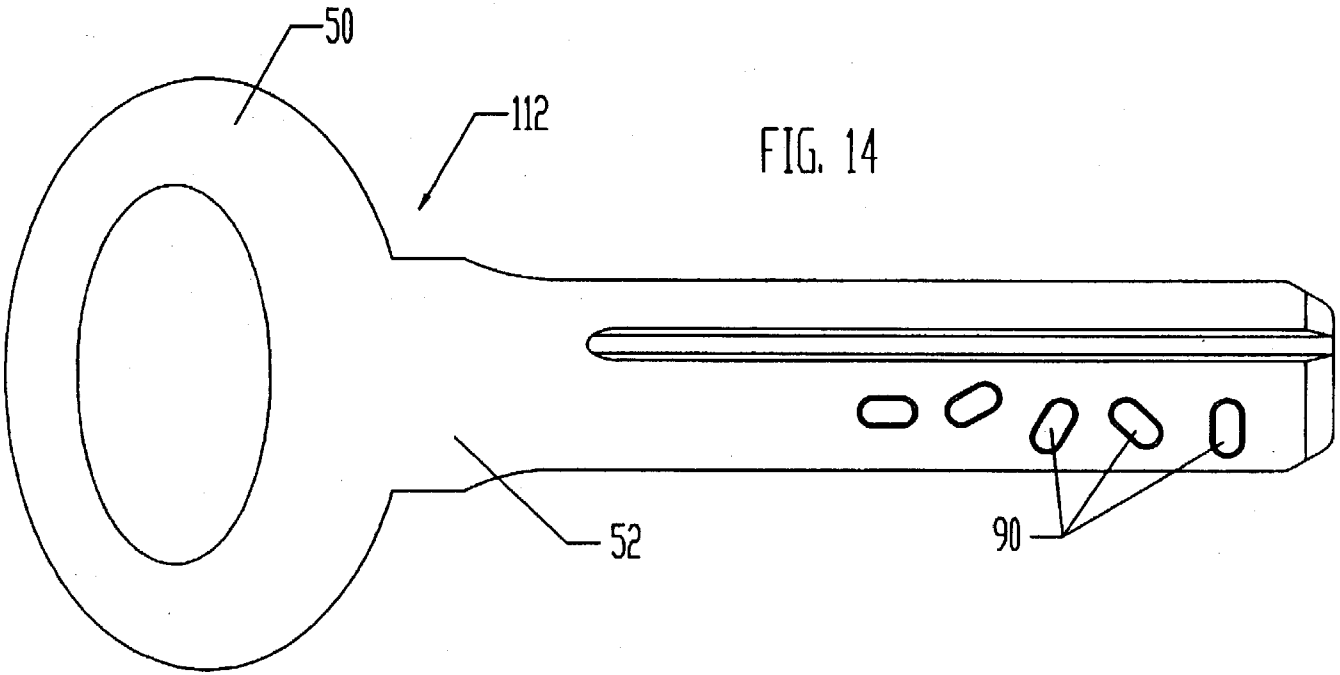
FIG. 14 is a perspective view of a non-changeable pin according to the present invention.

A key for use in a changeable cylinder lock of the present invention has been described heretofore as a key whose combination is also changeable (FIGS. 12 and 13). However, under certain circumstances, it may be desirable to use flat keys whose combination is not chargeable and whose combination is permanently fixed upon manufacture or cutting. Such a flat key would still enjoy a significant advantage over a conventional Medeco-type key in that a great many different angles can be used, rather than just a few angles (typically three) currently available with conventional Medeco-type keys. An example of such a flat key with unchangeable combination is shown in FIG. 14. Key 112 includes one or more permanent slits 90 which are dimensioned to accept the chisel-headed portions of the respective rotatable pins of a cylinder lock.

The procedure for simultaneously changing a cylinder lock and key would still be as described above with reference to FIGS. 9 and 10, so that at least one of the keys which operates the changeable cylinder lock would be of the changeable combination type (FIG. 12). However, once a new cylinder lock combination has been established, additional keys with the correct unchangeable combination (as in FIG. 14) may be made using any suitable process, rather than as described in FIG. 11 which shows a method for changing the combinations of additional changeable keys.

Figure 15:
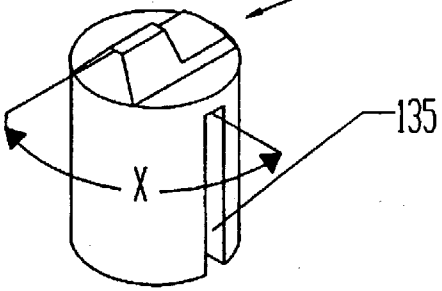
FIG. 15 shoes a non-changeable key according to another embodiment of the present invention.

A non-changeable key 112 (FIG. 14) may also be used with a cylinder lock whose combination is not changeable. Such a non-changeable cylinder lock would have a pin 130 (FIG. 15) which is made of a single part wherein the angle, X, between pin slot 135 and the chisel head for the particular pin is fixed upon manufacture. This one-piece construction is in contrast with the pin 30 (FIG. 5) made up of two rotatable parts of the previously described changeable cylinder lock embodiments.

While a non-changeable cylinder lock system suffers from the disadvantage that the combination of the cylinder lock cannot be changed, the system still enjoys the benefit of using a flat key with slits which can take on a large variety of angles (0° to 360°). The large number of angles greatly increases the number of possible combinations and thereby enhances the security of the lock.

While the invention has been described with respect to a limited number of embodiments, it will be appreciated that many variations, modifications and other applications of the invention may be made.

What is claimed is:

1. A cylinder lock having a changeable key combination, the cylinder lock comprising:

a cylinder housing defining a bore;

a plug arranged in said bore and defining a keyway; and at least one plug pin disposed in said plug along at least one plug pin axis and communicating with said keyway, said at least one plug pin having a key engagement end face communicating with said keyway, said key engagement end face being configured such that rotation of the plug pin about the plug pin axis effects a change in the key combination of the cylinder lock;

wherein said cylindrical housing defines at least one access opening which permits access to said at least one plug pin for selectable rotational positioning thereof for changing the key combination of the cylinder lock by means of rotation of the at least one plug pin about the at least one plug pin axis.

2. A cylinder lock according to claim 1 and also comprising a key including:

a key head;

a shank attached to the key head, said shank lying generally in a plane; and at least one key engagement end face engagement element arranged for engagement with said key engagement end face of said at least one plug pin, said at least one key engagement end face engagement element being rotatably mounted in said shank for selectable rotational positioning about a rotation axis generally perpendicular to said plane.

3. A cylinder lock according to claim 1 and wherein said key engagement end face has a non-axially symmetric configuration.

4. A cylinder lock according to claim 2 and wherein said key engagement end face has a non-axially symmetric configuration.

5. A cylinder lock according to claim 1 and wherein said at least one plug pin comprises a plurality of plug pins.

6. A cylinder lock according to claim 2 and wherein said at least one plug pin comprises a plurality of plug pins.

7. A cylinder lock according to claim 1 and wherein said key engagement end face has a configuration which is not symmetric under 180 degree rotation.

8. A cylinder lock according to claim 2 and wherein said key engagement end face has a configuration which is not symmetric under 180 degree rotation.

9. A cylinder lock according to claim 3 and wherein said key engagement end face has a configuration which is not symmetric under 180 degree rotation.

10. A cylinder lock according to claim 4 and wherein said key engagement end face has a configuration which is not symmetric under 180 degree rotation.

11. A cylinder lock according to claim 1 and wherein said at least one plug pin is arranged to be selectably rotatable without azimuthal restriction about said at least one plug pin axis when said pin rotation end face is rotatably engaged by a tool but not to be freely rotatable without azimuthal restriction otherwise.

12. A cylinder lock according to claim 2 and wherein said at least one plug pin is arranged to be selectably rotatable without azimuthal restriction about said at least one plug pin axis when said pin rotation end face is rotatably engaged by a tool but not to be freely rotatable without azimuthal restriction otherwise.

13. A cylinder lock according to claim 3 and wherein said at least one plug pin is arranged to be selectably rotatable without azimuthal restriction about said at least one plug pin axis when said pin rotation end face is rotatably engaged by a tool but not to be freely rotatable without azimuthal restriction otherwise.

14. A cylinder lock according to claim 4 and wherein said at least one plug pin is arranged to be selectably rotatable without azimuthal restriction about said at least one plug pin axis when said pin rotation end face is rotatably engaged by a tool but not to be freely rotatable without azimuthal restriction otherwise.

15. A cylinder lock according to claim 1 and wherein said at least one plug pin includes a collar portion which is arranged for selectable rotation relative to said end faces when said pin rotation end face is rotatably engaged by a tool and said collar portion is restrained against rotation, but not otherwise.

16. A cylinder lock according to claim 2 and wherein said at least one plug pin includes a collar portion which is arranged for selectable rotation relative to said end faces when said pin rotation end face is rotatably engaged by a tool and said collar portion is restrained against rotation, but not otherwise.

17. A cylinder lock according to claim 11 and wherein said cylinder lock comprises a side locking element for selectably locking engagement between said cylinder housing and said plug, said side locking element being arranged for mating engagement with said collar portion.

18. A key for use with a cylinder lock having a changeable key combination including a cylinder housing defining a bore extending along a first axis, a plug arranged in said bore and defining a keyway; and at least one plug pin disposed in said plug along at least one plug pin axis and communicating with said keyway, said at least one plug pin having a key engagement end face communicating with said keyway, said key engagement end face having a non-axially symmetric configuration;

the key comprising:

a key head;

a shank attached to the key head, said shank having a generally flat surface, having a first width and lying in a flat surface plane and at least one edge surface having an edge width which is less than said first width and lying in an edge plane angled with respect to said flat surface plane; and at least one key engagement end face engagement element arranged for engagement with said key engagement end face of said at least one plug pin, said at least one key engagement end face engagement element being rotatably mounted in said shank for selectable rotational positioning about a rotation axis generally perpendicular to said flat surface plane.

19. A method for simultaneously changing the key combination of a cylinder lock and of a key inserted therein, wherein the cylinder lock comprises:

a cylinder housing defining a bore extending along a first axis;

a plug arranged in said bore and defining a keyway; and at least one plug pin disposed in said plug along at least one plug pin axis and communicating with said keyway, said at least one plug pin having a key engagement end face communicating with said keyway, said key engagement end face having a non-axially symmetric configuration, wherein said cylindrical housing defines at least one access opening which permits access to said at least one plug pin for selectable rotational positioning thereof, and the key comprises:

a key head;

a shank attached to the key head; and at least one key engagement end face engagement element arranged for engagement with said key engagement end face of said plug pins, said at least one key engagement end face engagement element being rotatably mounted in said shank for selectable rotational positioning, the method comprising:

inserting the key into the keyway such that said at least one key engagement end face engagement element is in engagement with a corresponding key engagement end face of said at least one plug pin;

positioning said key and said plug such that said pin rotation end face of said at least one plug pin opposite said key engagement end face is accessible through said at least one access opening;

inserting a tool through said at least one access opening to engage a pin rotation end face of at least one plug pin, while at the same time the key engagement end face of said plug pin is in engagement with a corresponding said key engagement end face engagement element; and rotating said tool in engagement with said pin rotation end face of a plug pin, while at the same time the key engagement end face of said plug pin is in engagement with a corresponding said key engagement end face engagement element, thereby rotating said key engagement end face engagement element by an amount corresponding to the rotation of the plug pin.

20. A key for use with a cylinder lock having a changeable key combination including a cylinder housing defining a bore extending along a first axis, a plug arranged in said bore and defining a keyway and at least one plug pin disposed in said plug along at least one plug pin axis and communicating with said keyway, said at least one plug pin having a key engagement end face communicating with said keyway, said key engagement end face being configured such that rotation of the plug pin about the plug pin axis effects a change in the key combination of the cylinder lock, the key comprising:

a key head;

a shank attached to the key head, said shank having a generally flat surface, having a first width and lying in a flat surface plane and at least one edge surface having an edge width which is less than said first width and lying in an edge plane angled with respect to said flat surface plane; and at least one key engagement end face engagement element arranged for engagement with said key engagement end face of said at least one plug pin, said at least one key engagement end face engagement element being rotatably mounted in said shank for selectable rotational positioning about a rotation axis generally perpendicular to said flat surface plane and subsequently fixable so as to resist further rotational positioning.

* * * * *